United States Patent [19]

Crandon et al.

[11] Patent Number: 4,643,429

[45] Date of Patent: Feb. 17, 1987

[54] EDUCATIONAL BOARD GAME

[76] Inventors: Peter D. Crandon; Melody A. Crandon; William B. Holman; John P. Holman, all of 1500 Remsing, Hartland, Mich. 48029

[21] Appl. No.: 732,921

[22] Filed: May 13, 1985

[51] Int. Cl.[4] ..... A63F 3/04

[52] U.S. Cl. ..... 273/251; 273/257

[58] Field of Search ..... 273/257, 254, 251, 279

[56] References Cited

U.S. PATENT DOCUMENTS

| | | | |
|---|---|---|---|
| 1,346,826 | 7/1920 | Huggins | 273/254 |
| 3,318,601 | 5/1967 | MacLeod | 273/257 |
| 3,545,762 | 12/1970 | Atkinson | 273/257 |

*Primary Examiner*—Richard C. Pinkham
*Assistant Examiner*—Stuart W. Rose
*Attorney, Agent, or Firm*—Gifford, Groh, VanOphem, Sheridan, Sprinkle & Dolgorukov

[57] ABSTRACT

The present invention provides an educational game for two or more players which is designed to both entertain and educate the players regarding the electoral process of the president of the United States. The game has a game board depicting the map of the United States with the states and the electoral votes assigned to that state indicated on the map. Furthermore, the map is divided into a plurality of different regions wherein each region includes a plurality of contiguous states. A game piece is associated with each player which the player moves between states in dependence on the outcome of a chance device, such as a roll of dice. Upon landing on a given space, the player, by correctly answering a governmental question from a question card, is assigned that number of electoral votes for that particular state. The first player to accumulate more than one-half of the electoral votes and thereafter return to Washington, D.C. and correctly answers a final question, wins the game. In addition, the winning player must accumulate at least one electoral vote from each region of the United States.

4 Claims, 6 Drawing Figures

EDUCATIONAL BOARD GAME

BACKGROUND OF THE INVENTION

I. Field of the Invention

The present invention relates generally to educational board games and, more particularly, to an educational board game designed to provide both entertainment as well as teach the electoral system of electing presidents of the United States.

II. Description of the Prior Art

There are a number of previously known board games which utilize game board pieces which move about the game board in one fashion or another. None of these previously known games, however, simultaneously provides entertainment for the players as well as educate the players about the government of the United States.

In particular, none of these previously known game boards are designed to educate the game players regarding the electoral process for electing the president of the United States. The electoral process, furthermore, is somewhat difficult to comprehend since the president of the United States is not elected by majority vote of the citizens but, instead, elected by the majority vote of the electoral college. The electoral college, in turn, consists of a number of votes assigned to each state in the union, so that it is possible for a president of the United States to obtain a majority of the votes from the electoral college and yet obtain only a minority of the popular vote.

Likewise, there are no games known to Applicants that are designed to teach historical facts about government and past presidents of the United States in an entertaining fashion. Rather, such historical facts are typically learned by memorization which is dull and tedious.

SUMMARY OF THE PRESENT INVENTION

The present invention provides a game which overcomes all of the above mentioned disadvantages of the previously known games.

In brief, the educational game of the present invention comprises a game board comprising a map of the United States and wherein each state and the electoral votes assigned to each state is indicated on the map. Each player is assigned a game board piece which is moved through the states on the map in accordance with the outcome from a chance device, such as dice.

Upon landing on a particular state, the player is asked a governmental question from a question card and, if the question is correctly answered, awarded the votes from the electoral college corresponding with that particular state. (Each player can be awarded the electoral votes from a particular state by landing on that particular state and correctly answering the question so that up to six players can play the game.) The player then continues to move his game piece until a question is incorrectly answered. On a subsequent turn, the player may either move to a different state depending upon the outcome of the chance device or, alternatively, remain in the same state and attempt to answer another question.

The first player to accumulate the necessary electoral votes to win election to the presidency of the United States and who thereafter returns to Washington, D.C. and answers a final question is declared the winner of the game. However, in order to win the game, it is necessary for the player to obtain at least one electoral vote from each region of the United States which enhances the fun and excitement of the overall game.

The education game of the present invention thus not only provide an exciting an challenging game for game players, but also educates the players in the governmental process of the United States and especially the electoral college process for electing the United States president as well as historical facts regarding past presidents.

BRIEF DESCRIPTION OF THE DRAWING

A better understanding of the present invention will be had upon reference to the following detailed description, when read in conjunction with the accompanying drawing wherein like reference characters refer to like parts throughout the several views, and in which.

DETAILED DESCRIPTION OF A PREFERRED EMBODIMENT OF THE PRESENT INVENTION

Figure 1:
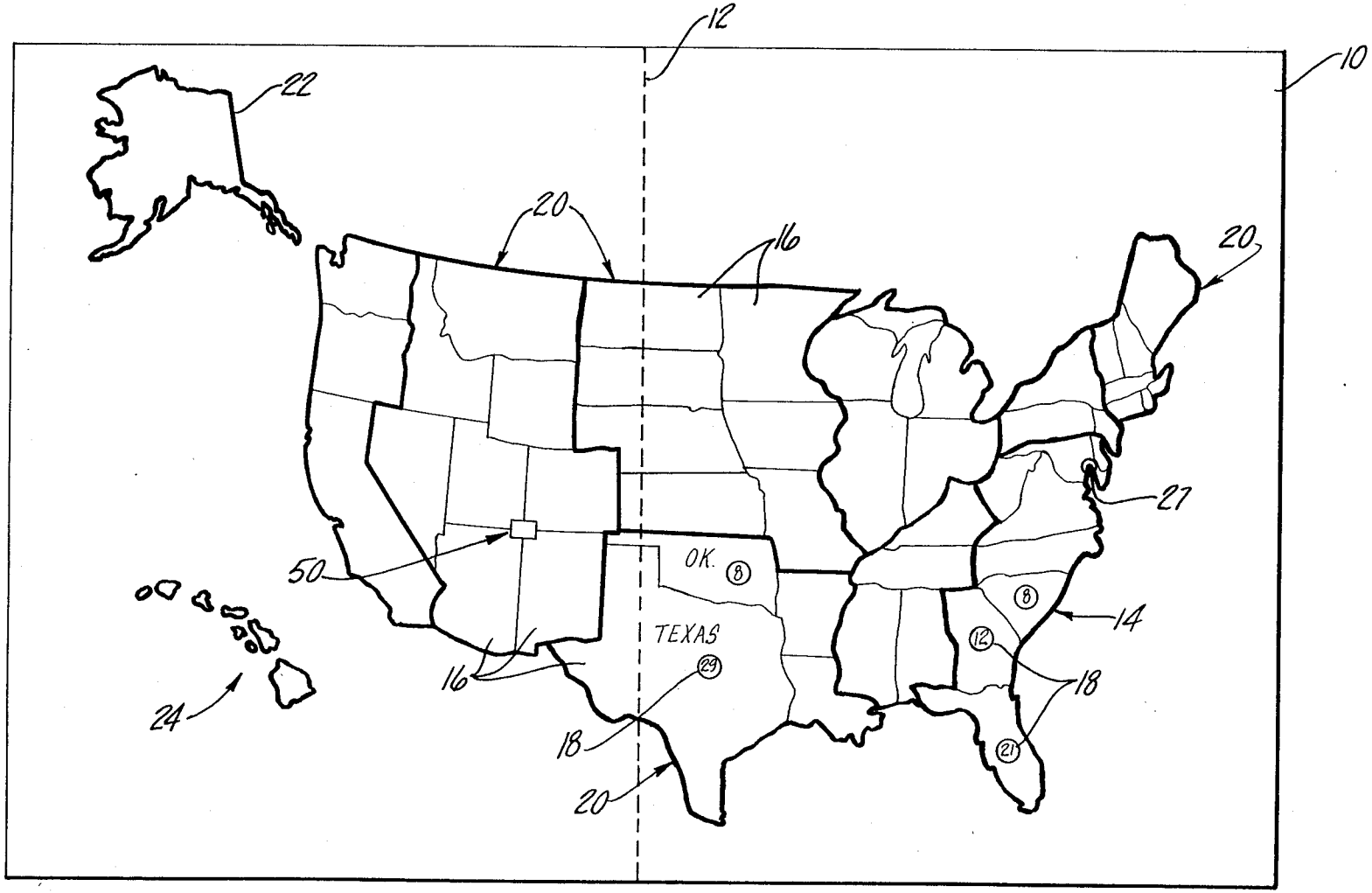
FIG. 1 is a plan view illustrating a preferred embodiment of the board for the game of the present inventin.

With reference first to FIG. 1, a preferred game board 10 for the game of the present invention is thereshown which may be of any conventional construction and may include a fold 12 for compact storage. A map 14 of the United States is printed on one side of the game board 10 with the boundaries between the various states 16 shown. In addition, the number of votes for the electoral college for each states are clearly indicated on the map 14 as shown at 18.

Still referring to FIG. 1, the map 14 is divided into several different regions 20 wherein each region 20 includes several contiguous states except, of course, Alaska 22 and Hawaii 24 which are not contiguous to any other state in the union. Consequently, Alaska 22 is considered to be contiguous to the North Western region of the United States while Hawaii 24 is considered to be contiguous to California for purposes of playing the game. Other regions of the United States includes the South Atlantic region, Midwest region, New England region and the like.

Figure 5:
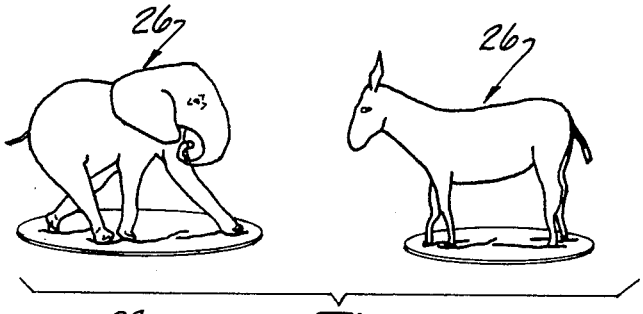
FIG. 5 are exemplary game pieces for the preferred embodiment of the present invention.

With reference now to FIG. 5, the game of the present invention is designed to accommodate between two and six players and each player is assigned one game board piece 26 (only two illustrated). Each game board piece 26 differs from the other game board pieces in one fashion or another. However, preferably each game board piece 26 includes the logo or representation of a particular party, such as an elephant for the Republican party, donkey for the Democratic party and the like. As described below, these game board pieces 26 are moved between the various states on the map 14 in order to accumulate the necessary points or electoral votes to win the game.

Figure 6:
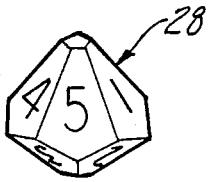
FIG. 6 is a plan view of a die.

At the start of play of the game, each player places his or her game board piece 26 on or adjacent Washington, D.C. 27 on the map 14. A change device, such as a die 28 as shown in FIG. 6 or a spinner (not shown) is used to determine who moves first in the game. The player who wins the first turn of the game then again rolls the die 28 and moves his game piece 26 one state for each point rolled on the die 28. The actual order and direction in which the game player moves his or her game piece 26 on the game board map 14 is left to the discretion and skill of the player.

Figure 4:
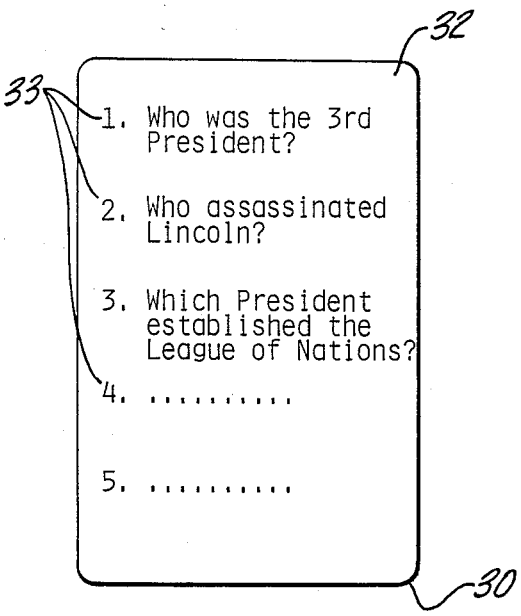
FIG. 4 is a plan view illustrating one side of a question card for the preferred embodiment of the present invention.

With reference now to FIGS. 1 and 4, the present invention further comprises a plurality (only one shown) of question cards 30 (FIG. 4) wherein one side 32 of each card includes a plurality of governmental questions 33, i.e. questions relating to historical facts of past presidents of the United States and the like. Furthermore, preferably each question card 30 includes a plurality of different questions and the answer to each question is indicated on the reverse side (not shown) of the question card 30.

Figure 2:
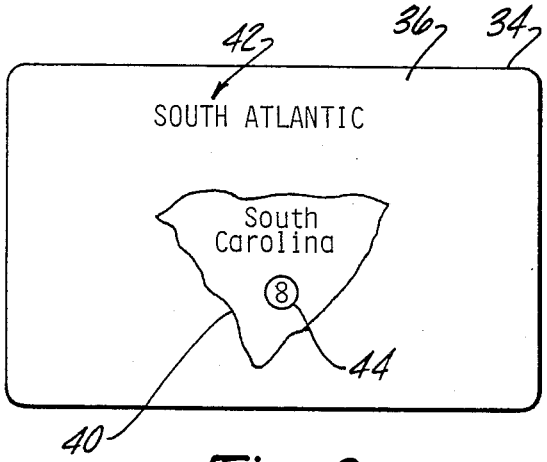
FIG. 2 is a plan view illustrating one side of a playing card of the preferred embodiment of the invention.
Figure 3:
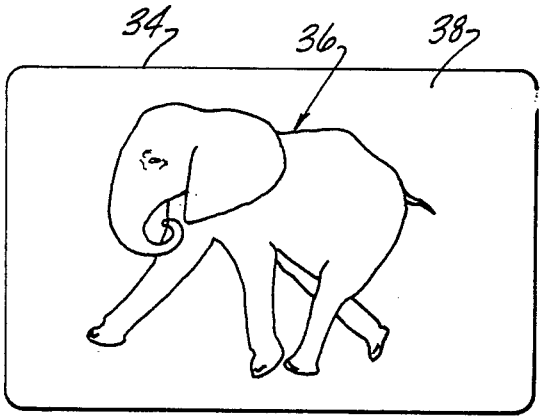
FIG. 3 is a plan view illustrating the other side of a playing card of the preferred embodiment of the invention.

With reference now to FIGS. 1–3 in the event that the player correctly answers the question on the question card, the player is awarded a point card 34 having a front side 36 (FIG. 2) and a reverse side 38 (FIG. 3). The front side 36 of the point card 34 illustrates both a map 40 of the state that the player has landed on, the region 42, e.g. South Atlantic, that the state is located as well as the number 44 of electoral votes allotted to that particular state. The reverse side 38 of the point card 34 includes indicia 36 which is representative of the political party associated with the player who correctly answered the question.

In order to allow the game to be played by up to six players, there is a point card 34 for each state for each player. For example, assuming six players, there are six Florida cards, six Alabama cards, et cetera. The point cards for a particular state, furthermore, will vary only by the indicia 46 on the reverse side 38 of the point card 34.

After the player has correctly answered the question as described above, the player takes another turn by rolling the die 38 and then moves to a different state whereupon the above process is repeated until the player incorrectly answers the question from the question card 32. At that time, play of the game passes to the next player. In addition, at the player's next turn, the player, at his or her option, may roll the die to move to a different state or, alternately, say on the present state and attempt to answer another question.

In order to win the game, the player must accumulate the number of electoral votes necessary for election to the presidency of the United States, i.e. two hundred seventy electoral votes as represented by the sum of the indicia 44 on the point cards 34. Furthermore, the player must obtain at least one electoral college vote from each of the regions 20 from the map 14.

After the player accumulates the necessary votes for election to the presidency of the United States, the player must return to Washington to complete the game. Furthermore, at each state on which the players game piece lands on his or her return to Washington for the finish of the game, the player must correctly answer a question from one of the plurality of question cards 30 before the player may proceed to Washington, regardless of whether or not the player has already obtained the electoral votes from that particular state. This feature of the game thus enhances the overall excitement of the game in that it slows the finish of the game and allows the other players to catch up to the leading player. Furthermore, when returning to Washington after the necessary number of electoral votes had been obtained, when the player lands on either Virginia or Maryland, that player must correctly answer a question before attempting a roll of either one or six of the die 28 which allows the player to enter Washington, D.C. and, after answering one further question from a question card 30, win the game.

There are also a number of rules regarding the movement of the game pieces 26 on the game board 10 which enhance the overall excitement and enjoyment of the game. Perhaps most importantly, players are not allowed to either land or pass through states on which another players game piece 26 is positioned. This provision of the game thus allows players to block the movement of a leading player by surrounding the state on which the leading players game piece 26 is positioned so that the leading player cannot move his piece and obtain more electoral votes. An exception to this rule, however, is made for players trying to enter Washington, D.C. in which case multiple game pieces 26 can occupy Maryland or Virginia, i.e. the states contiguous to Washington, D.C.

In addition, each player must obtain the electoral votes for either Hawaii or Alaska before he or she can win the game.

Further rules of movement of the game pieces 26 around the game board 10 require that a player entering the state of Alaska 22 do so through the state of Washington. Likewise, a player must enter the state of Hawaii 24 through the state of California. Players are also prohibited from crossing states diagonally in the four corners area between Utah, Colorado, New Mexico and Arizona and a box 50 at the four corners area is provided on the map 14 to remind players of this rule.

From the foregoing, it can be seen that the game of the present invention provides an entertaining, exciting and yet educational game which teaches players not only about the history of government and past presidents of the United States, but also the process of the electoral college for electing presidents of the United States.

Having described our invention, however, many modifications thereto will become apparent to those skilled in the art to which it pertains without deviation from the spirit of the invention as defined by the scope of the appended claims.

We claim:

1. An educational game for two or more players comprising:

a game board depicting a map of the United States, said map including boundaries for each state and each state having a predetermined electoral vote, a chance device, at least two game pieces, each game piece being associated with each player and being movable between states on said game board map, the number of moves at a turn being determined by said chance device, a plurality of point cards, one point card being associated with each game piece for each state, each point card for each state having first indicia means on one side of the point card corresponding to the identity of the state and the number of electoral votes for the particular state, and each point card for each state having second indicia means on its other side corresponding to only one of the game pieces so that one point card is associated with each player for each state, a plurality of question cards, each having a front and rear surface, at least one governmental question being imprinted on the front surface of each card and the answer to said at least one governmental question being imprinted on the rear surface of each said question card, wherein, with a player's gamepiece on a state in said map, upon correctly answering the governmental question on one of said question cards, said last mentioned player is awarded the point card associated with said last mentioned player for said last mentioned state, wherein the player who first receives the number of points on said point cards corresponding to the number of electoral votes necessary for election to the Presidency of the United States and thereafter returns to a predetermined place on said map wins the game, and wherein, except for states contiguous to said predetermined place on the map, each game piece positioned on a state forms a blocking means to prevent other game pieces from landing on said last mentioned state.

2. The invention as defined in claim 1 wherein said map is divided into several geographic regions, each region comprising a plurality of states, and wherein, to win, a player must obtain at least one point card from each region and wherein said first indicia means on said point card includes means for identifying said region.

3. The invention as defined in claim 1 wherein said predetermined place on said map is Washington, D.C.

4. The invention as defined in claim 1 wherein, on the next turn of a player incorrectly answering a question from said question card, at the players option the player may move to or elect not to move to a different state.

* * * * *